US005461895A

United States Patent [19]

Lemper et al.

[11] Patent Number: 5,461,895

[45] Date of Patent: Oct. 31, 1995

[54] HIGH CAPACITY HYDRAULIC LEVELLER

[75] Inventors: Herbert Lemper, McMurray; Robert H. Ellis, Oakmont; Richard A. Fabian, Allison Park, all of Pa.

[73] Assignee: Danieli United, Inc., Pittsburgh, Pa.

[21] Appl. No.: 164,384

[22] Filed: Dec. 9, 1993

[51] Int. Cl.[6] ..... B21D 1/02

[52] U.S. Cl. ..... 72/21; 72/165

[58] Field of Search ..... 72/164, 165, 160, 72/21

[56] References Cited

U.S. PATENT DOCUMENTS

| | | | |
|---|---|---|---|
| 3,596,489 | 8/1971 | Ball | 72/246 |
| 3,877,270 | 4/1975 | Marten | 72/21 |
| 4,454,738 | 6/1984 | Buta | 72/164 |
| 4,676,085 | 6/1987 | Ellis | 72/20 |
| 4,730,472 | 3/1988 | Ellis | 72/21 |
| 4,811,586 | 3/1989 | Benz | 72/165 |
| 5,038,591 | 8/1991 | Tajima | 72/21 |

FOREIGN PATENT DOCUMENTS

| | | | |
|---|---|---|---|
| 570770 | 11/1993 | European Pat. Off. | 72/164 |
| 151118 | 6/1991 | Japan | 72/164 |

*Primary Examiner*—Daniel C. Crane

*Attorney, Agent, or Firm*—Armstrong, Westerman, Hattori, McLeland & Naughton

[57] ABSTRACT

An improved plate leveller comprising a housing, a rigid top beam and a bottom beam mounted on the housing, a flexible beam disposed between the upper rigid beam and the bottom beam and connected at the ends thereof to secondary bending cylinders mounted on the rigid top beam, upper back-up roll assemblies mounted on the flexible beam, lower back-up roll assemblies mounted on the lower beam, upper and lower work rolls disposed between the back-up roll assemblies, and a primary bending cylinder mounted on the rigid top beam and bearing on an upper surface of the flexible beam and, with the secondary bending cylinders, bending the flexible beam to counteract deflection of the bottom beam under load, thereby to maintain the upper and lower work rolls in parallel relationship to each other and providing uniform dimensions of plate passed therebetween.

9 Claims, 6 Drawing Sheets

HIGH CAPACITY HYDRAULIC LEVELLER

BACKGROUND OF THE INVENTION

1. Field of the Invention

This invention relates to improved apparatus and methods for levelling metal plate, particularly heavy metal plate which exerts high separating forces tending to distort the work rolls and resulting in non-uniform levelled plate dimensions. The invention is directed especially to improved means and methods for automatically compensating for work roll distortion under such heavy loads and thereby providing uniformly dimensioned product.

2. Description of Related Art

U. S. Pat. No. 3,596,489 discloses an apparatus for processing sheet or strip material between a pair of work rolls and including a flexible beam supported at its ends in the apparatus housing and a further beam relatively stiff compared to the flexible beam. Back-up rolls are mounted on the underside of the flexible beam and engage a number of upper work rolls. As the work rolls deflect under load, the flexible beam is flexed by a number of hydraulically or pneumatically driven piston/cylinder assemblies to apply compensating forces along the length of the upper work roll in opposition to forces acting on the roll due to material in the roll gap. The fixed ends of the flexible beam limit the size and distribution of compensating forces applicable through the flexible beam and require the use of movable piston/cylinder assemblies which are slidably mounted across the length of the work rolls. Moreover, the invention of this patent requires manual control of application of the compensating forces in response to changes in roll distortion due to the roll separation forces.

U.S. Pat. No. 4,730,472 discloses a leveller wherein upper back-up rolls are mounted on an intermediate support frame of limited flexure and which can be flexed, by means of a plurality of hydraulic piston/cylinder assemblies fixed in a top main frame of the apparatus, in order to contour the levelling action. Each cylinder is controlled by a servo valve which can be adjusted by the operator to work sheet material across its width, depending on sheet flatness. Variations in sheet thickness result in variation in pressures against the working roll nearest the defect, which pressures are transferred to back-up rolls and thence to the flexible intermediate beam which then tends to flex and compensate for such pressure excursions. Such flexure causes movement of the piston and such movement is sensed by a position transducer to generate a signal to a summing amplifier which compares the input signal to a reference position signal. Amplifier output then actuates the servo valve and a pump motor to send hydraulic fluid to the affected cylinder or to vent cylinder pressure, thus restoring the piston to an initial position to counter the loading variation on the work roll caused by the sheet material. Thus, automatic control of the piston/cylinder assemblies is actuated only by variations in thickness of material being processed. There is no provision for continuous monitoring and correction of deflection of the top or bottom beams respectively carrying the top and bottom roll assemblies.

SUMMARY OF THE INVENTION

The present invention comprises top and bottom roll assemblies supported by near rigid top and bottom beams. Each roll assembly comprises a number of work rolls each of which is supported by a plurality of back-up roll assemblies. The bottom beam is supported by leveller housings in a manner generally known to the art. Bottom beam deflection is monitored continuously to provide bottom beam distortion information for control of the top roll assembly. The latter includes a near rigid top beam provided with a number of force cylinders by means of which the roll gap is determined. A flexible beam is positioned between the top beam and the upper work rolls and supports the upper back-up roll assemblies, with the ends of the flexible beam supported by secondary bending piston/cylinder assemblies which, with a centrally-disposed primary bending piston/cylinder assembly, serve to bend the flexible beam responsive to information regarding distortion of the bottom beam. Position transducers measure the deflection of the bottom beam and send such information to a position control loop that provides constant input to control valves that energize the bending piston/cylinder assemblies. Feed back information from other position transducers that constantly measure the top beam deflection is compared to the bottom beam deflection to eliminate deviations and assure parallel roll assemblies under any load condition, thereby providing equal levelling forces across the entire plate width.

DESCRIPTION OF THE PREFERRED EMBODIMENTS

Figure 1:
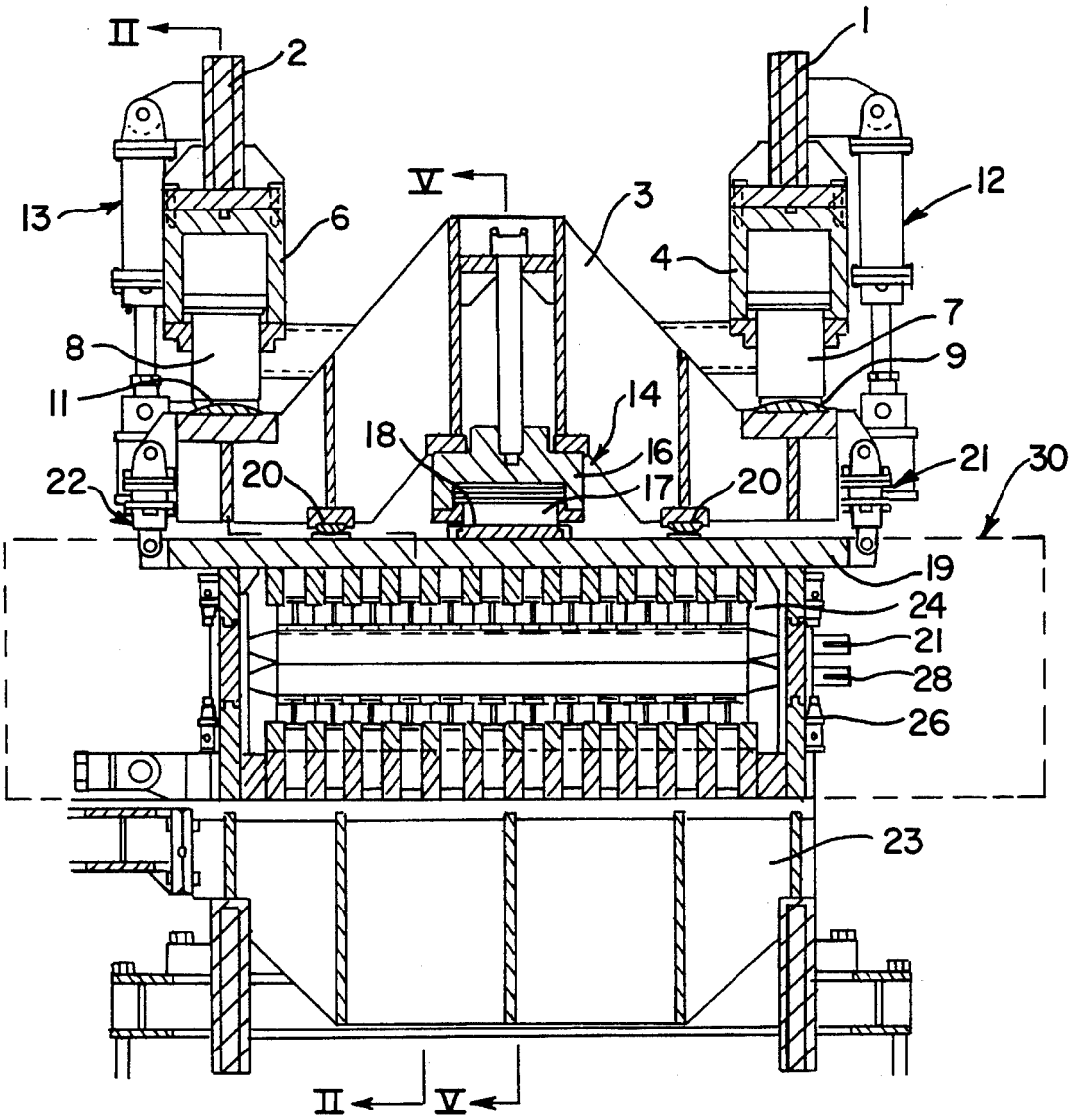
FIG. 1 is a front sectional elevation of the apparatus of the invention.
Figure 2:
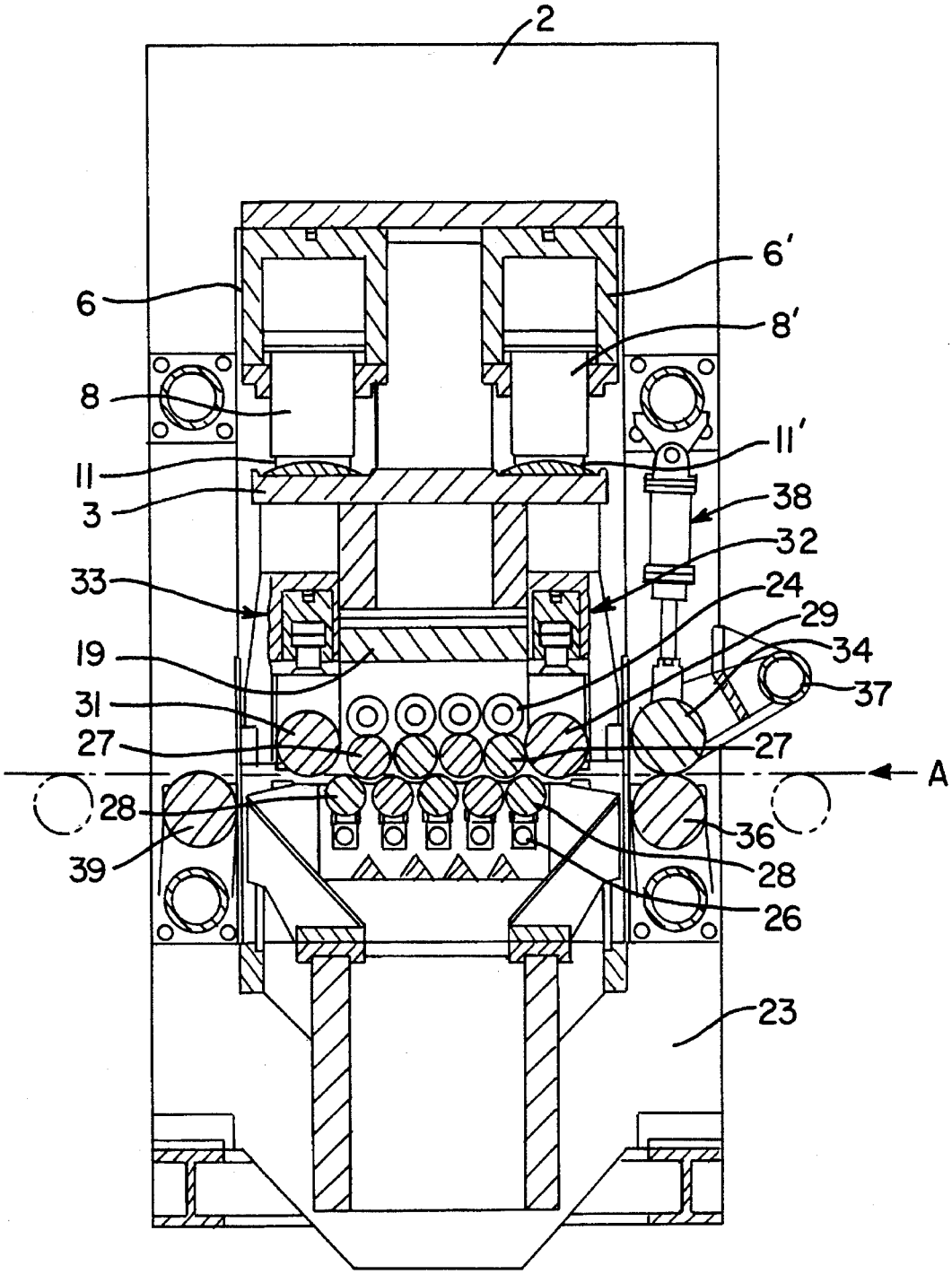
FIG. 2 is a side sectional elevation taken along line II—II of FIG. 1.
Figure 3:
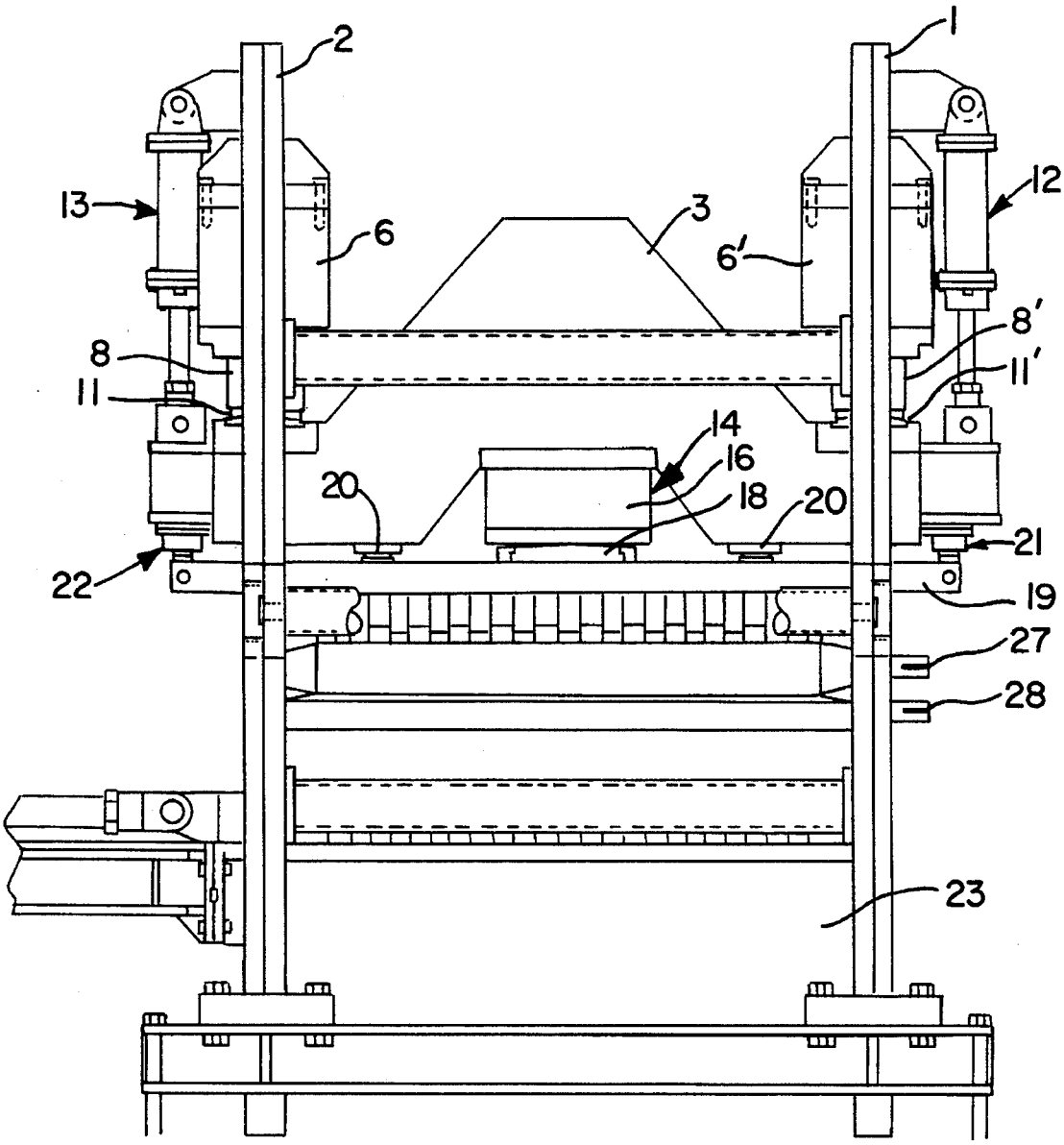
FIG. 3 is a front elevational view of the apparatus of the invention.

Looking first at FIGS. 1, 2 and 3, the numerals 1 and 2 denote respectively first and second housing parts. A near rigid top beam 3 is mounted on housing parts 1 and 2. A pair of force cylinders 4, 4' are mounted on housing part 1 and a similar pair of force cylinders 6, 6' are mounted on housing part 2. Slidably mounted within force cylinder 4 is a piston 7. Similarly a piston 7' is mounted in cylinder 4' a piston 8 is mounted in cylinder 6, and a piston 8' is mounted in cylinder 6' Lower ends of pistons 7, 7' 8 and 8' bear, respectively, against convexly-shaped bearing surfaces 9, 9', 11 and 11' on the top beam 3.

Two pairs of support piston/cylinder assemblies denoted generally by the numerals 12, 12' and 13, 13' are connected, respectively, at one end to the housing parts 1 and 2 and, at the other end, to opposite ends of the top beam 3 and serve to carry the weight of the latter element.

A primary bending piston/cylinder assembly, denoted generally by the numeral 14, and comprising cylinder 16 and piston 17, is mounted on the top beam 3. The lower end of piston 17 bears on a convexly-shaped bearing surface 18 which is mounted on a top surface of an intermediate flexible beam 19. Between the respective ends of the top beam 3 and the primary bending piston/cylinder assembly 14, the top beam is provided with a pair of convex bearing surfaces 20 also bearing against the upper surface of the flexible beam 19. The ends of flexible beam 19 are connected respectively to two pairs of secondary bending piston/cylinder assemblies, denoted generally by the numerals 21, 21' and 22, 22' carried by the top beam 3

A bottom beam 23 is mounted on the housing parts 1, 2.

Figure 4:
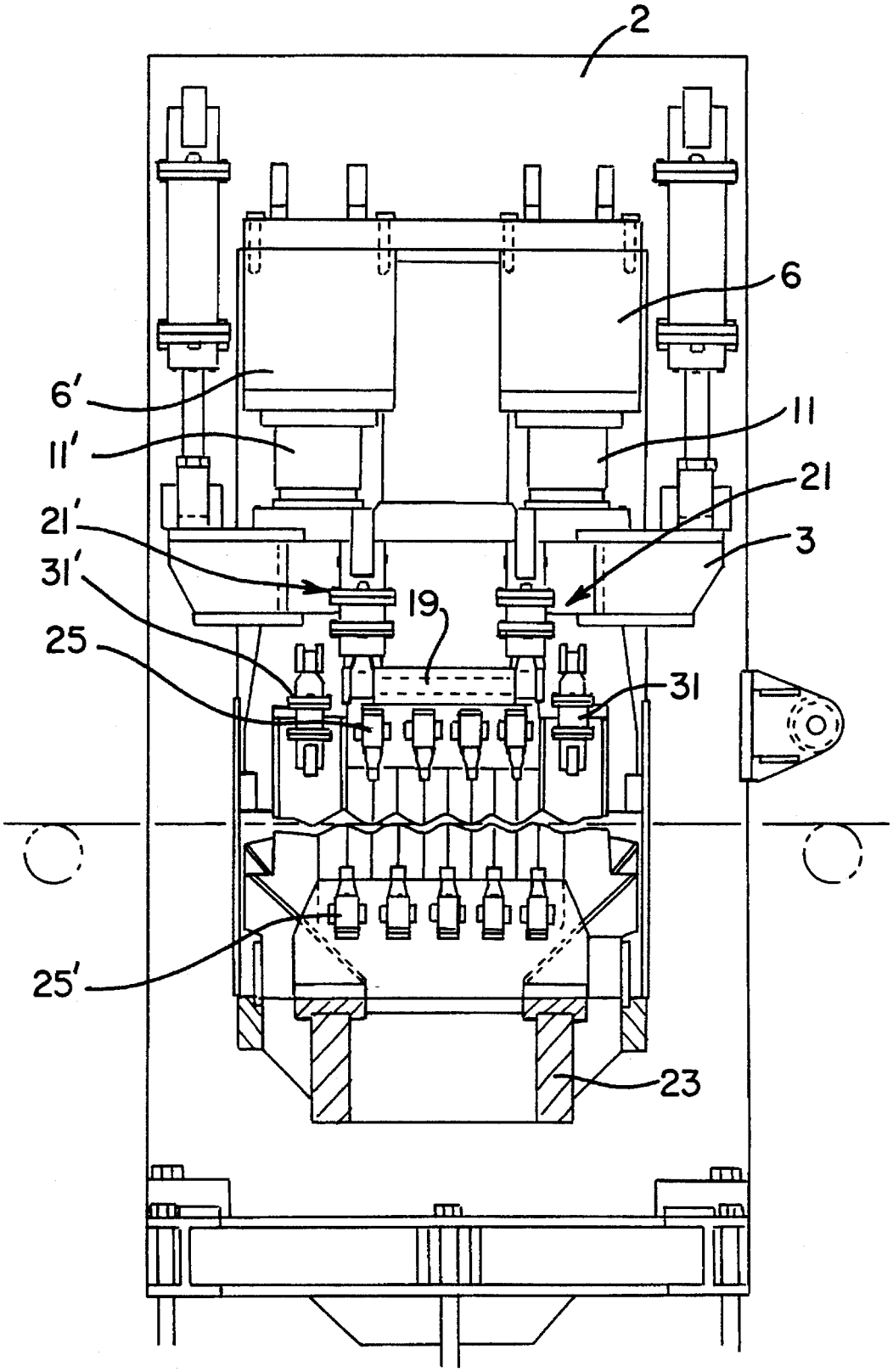
FIG. 4 is a side elevational view of the apparatus of the invention.
Figure 5:
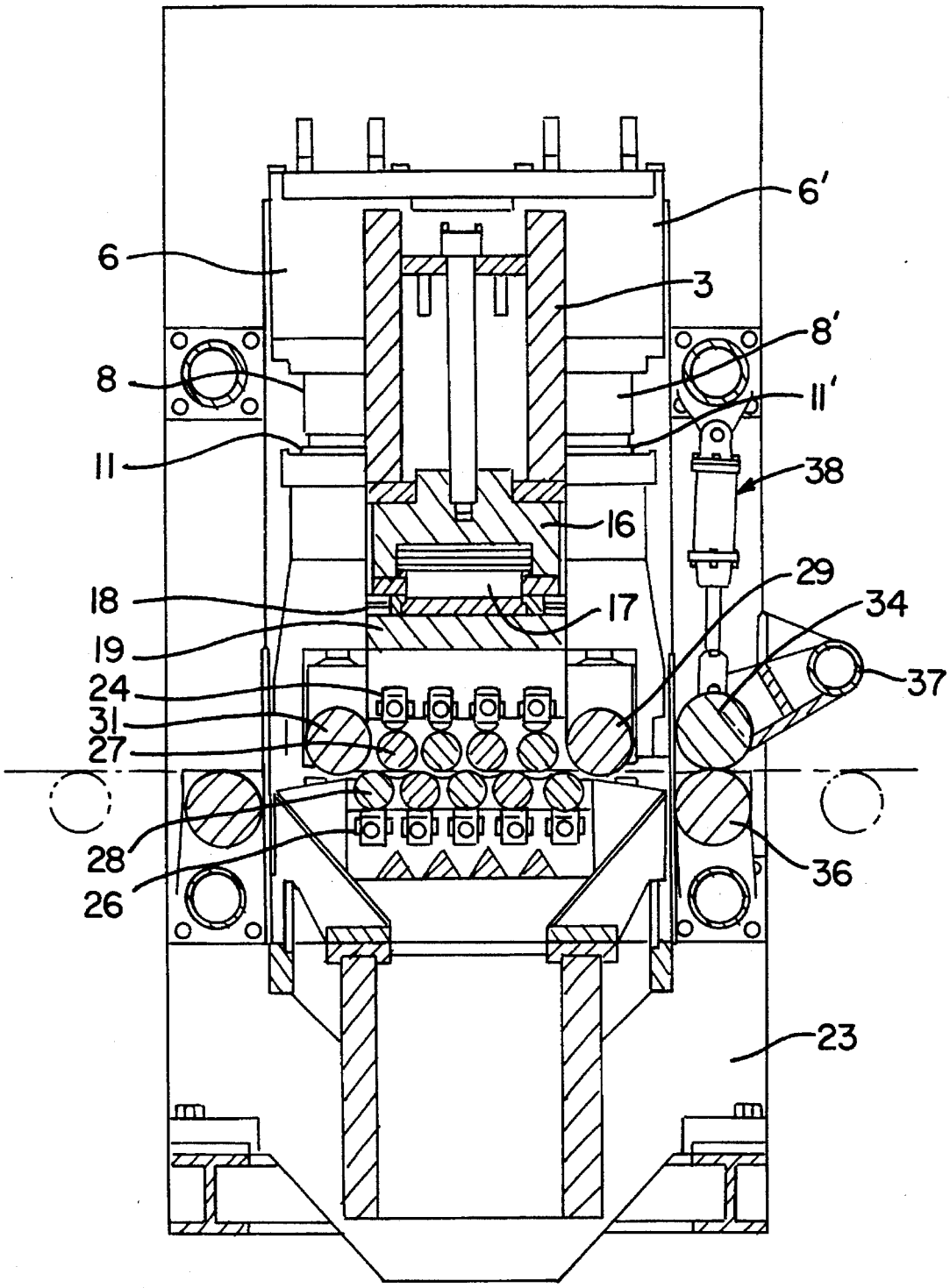
FIG. 5 is a side elevation taken along line V—V of FIG. 1.

A set 24, consisting of 4×12 or 48 roll assemblies, and a set 26 consisting of 5×12 or 60 roll assemblies, are mounted, respectively, on the intermediate flexible beam 19 and a removable roll cartridge 30 which is seated on the bottom beam 23. The elements within the dashed line 30 of FIG. 1 comprise the removable cartridge. Upper roll assemblies 24 are provided with upper roll balance cylinders 25, and the lower roll assemblies 26 are provided with lower roll balance cylinders 25' (FIG. 4). A set of driven upper work rolls 27 and a set of driven, off-set lower work rolls 28 are mounted between the roll assemblies 24, 26 and extend across the width of the apparatus, and are suitably journalled in the housing parts 1 and 2, as shown in FIG. 1.

As seen in FIG. 2, anvil rolls 29 and 31 are mounted above the pass line denoted by the arrow A, and are backed up by anvil roll piston/cylinder assemblies denoted generally by the numerals 32 and 33 mounted on the top beam 3. A pair of opposed pinch rolls 34 and 36 are mounted above and below the pass line of product passed through the apparatus. The top pinch roll 34, mounted on a pinch roll pivot 37, is movable in a generally vertical direction against the lower pinch roll 36 by means of a pinch roll piston/cylinder assembly denoted generally by the numeral 38.

A carrier roll 39 to facilitate exit of product from the apparatus is provided below the pass line and after the product leaves the work rolls.

Figure 6:
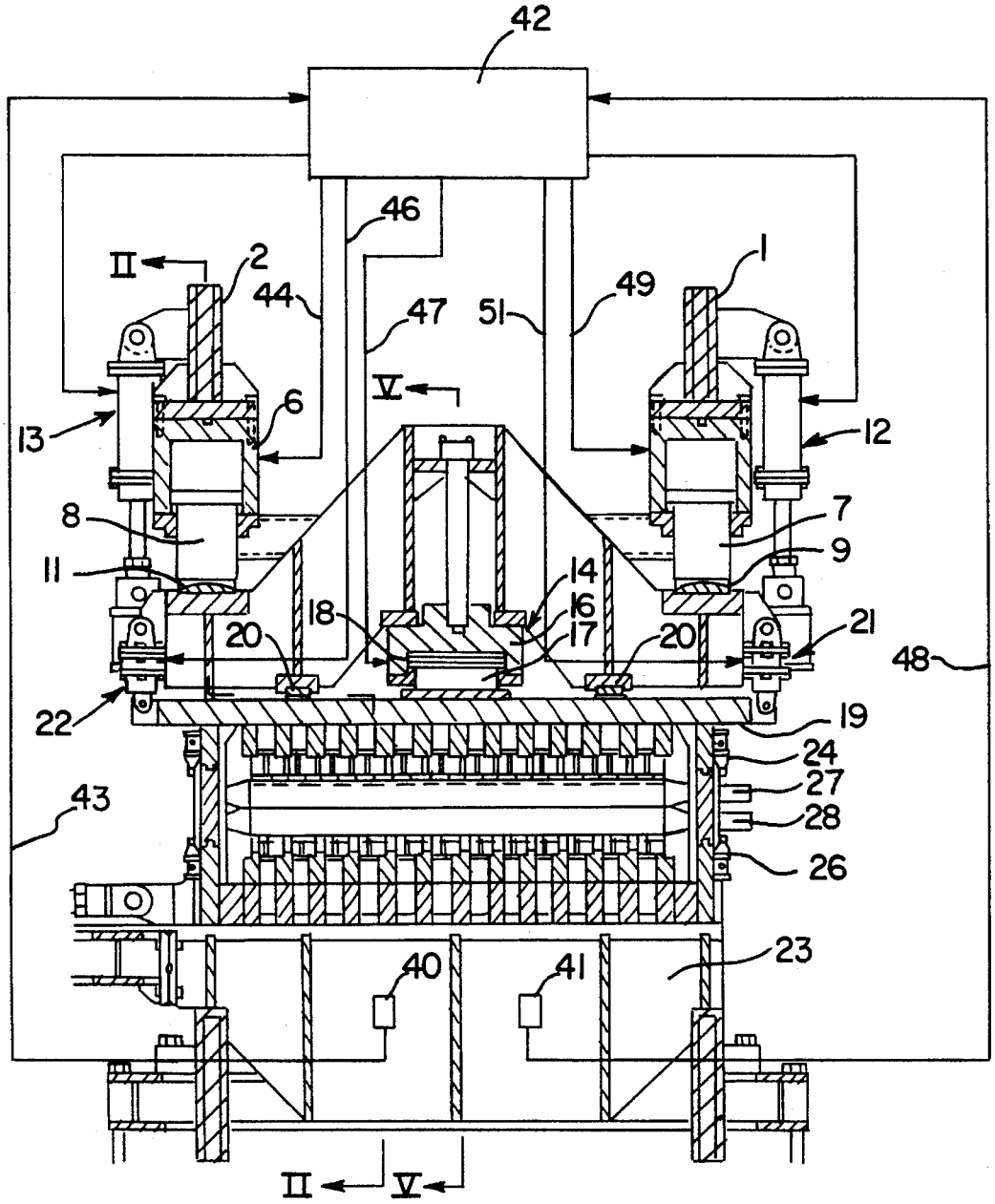
FIG. 6 is a view like FIG. 1, but showing electrical and hydraulic connections of the apparatus.

As shown in FIG. 6, position transducers 40 and 41 are affixed to bottom beam 23. Transducer 40 is connected through electrical line 43 to a cylinder position controller 42 comprising hydraulic control valves (not shown). Controller 42 is connected through hydraulic lines 44, 46 and 47, respectively to force cylinders 6, 6' secondary bending cylinders 22, 22' and primary bending cylinder/piston assembly 14. Transducer 41 similarly is connected through electrical line 48 to controller 42 which is connected, through hydraulic lines 49 and 51, respectively, to force cylinders 4, 4' and secondary bending cylinders 21, 21'.

In operation, a desired gap between the upper and lower work rolls is set by moving the upper roll assembly in a vertical direction by means of force cylinders 4, 4', 6 and 6'. Metal plate is passed, in the direction of arrow A (FIG. 2) into a gap of predetermined width between the work rolls. Actuation, by means of transducers 40 and 41 and controller 42, of primary bending piston/cylinder assembly 14 and secondary bending piston/cylinder assemblies 21, 21', 22 and 22' between the top beam and the work roll assembly compensate for the deflection of the beams under a levelling load. Thus, position transducers 40 and 41 measure the deflection of the bottom beam 23 and send a deflection magnitude signal to a position control loop that provides a bottom beam position input signal to control valves (controller 42) that energize the primary and secondary bending piston/cylinder assemblies to deflect the flexible beam 19 to an extent to duplicate the deflection of the bottom beam. Feed back information from other position transducers constantly measure the flexible beam deflection which is compared to the bottom beam deflection to eliminate deviations in roll gap and corresponding variations in plate thickness.

The invention provides infinite adjustability by providing distorting means between the top beam and the roll assemblies, thereby providing the means for a large adjustment range to assure that the top work roll assembly is parallel to the bottom roll assembly under load. By providing continuous control of the distortion means, the roll assemblies and the top and bottom beams are maintained parallel under any load condition. Parallel roll assemblies provide equal levelling forces across the entire plate width.

What is claimed is:

1. An improved leveller for heavy metal plate, comprising:

a leveller housing;

a near rigid top beam mounted on the housing;

bottom beam mounted on the housing:

a single flexible beam disposed between the near rigid top beam and the bottom beam;

an upper back-up roll assembly mounted on the flexible beam;

a lower back-up roll assembly mounted on the bottom beam;

a set of four secondary bending piston/cylinder assemblies each of which is connected at one end to the top beam and connected at the other end to an end of the flexible beam;

a primary bending piston/cylinder assembly mounted on the top beam and having a lower end of the piston component thereof bearing against a convex upper surface of the flexible beam at a position intermediate the ends of the flexible beam;

the top beam having a pair of convex surfaces bearing on the flexible beam on either side of the primary bending piston/cylinder assembly;

a set of driven upper work rolls disposed below the upper back-up roll assembly and above and vertically movable with respect to a set of driven lower work rolls disposed above the lower back-up roll assembly and off-set from the upper work rolls so as to exert a levelling action on plate passed through the work rolls, and means continuously to measure the deflection of the bottom beam and to actuate the primary and secondary bending piston/cylinder assemblies to deflect the flexible beam to an extent to compensate for the deflection of the bottom beam, thereby continuously maintaining the upper and lower work roll assemblies parallel to each other under load.

2. An improved leveller for heavy metal plate, comprising:

a leveller housing;

a near-rigid top beam mounted on the housing;

a bottom beam mounted on the housing;

a flexible beam disposed between the top beam and the bottom beam;

an upper back-up roll assembly mounted on the flexible beam;

a lower back-up roll assembly mounted on the bottom beam;

a plurality of secondary bending piston/cylinder assemblies each of which is connected at one end to the top beam and connected at the other end to an end of the flexible beam;

a primary bending piston/cylinder assembly mounted on the top beam;

a first, upwardly convex surface on the flexible beam at a position intermediate the ends of the flexible beam and against which convex surface a lower end of the piston component of the primary bending piston/cylinder assembly bears on actuation of said piston;

a set of driven upper work rolls disposed below the upper back-up roll assemblies and above and vertically movable with respect to a set of driven lower work rolls disposed above the lower back-up roll assemblies and off-set from the respective upper work rolls so as to exert a levelling action on plate passed through the work rolls, and means to measure deflection of the bottom beam and to actuate the primary and secondary bending piston/cylinder assemblies to deflect the flexible beam to an extent to compensate for the deflection of the bottom beam, thereby to maintain the upper and lower work roll assemblies parallel to each other under load.

3. An apparatus according to claim 2, further comprising position detecting means to detect deflection of the bottom beam, controller means and controlled servo-valve adjusting means to receive a bottom beam deflection signal from the position detecting means and to adjust the positions of the pistons in the primary and secondary bending cylinders thereby to bend the flexible beam to an extent such that the flexible beam and the associated upper roll assembly are maintained parallel to the deflected bottom beam and the associated lower roll assembly.

4. An apparatus according to claim 3, wherein the principal bending force applied to the flexible beam is applied by the primary piston/cylinder assembly.

5. An apparatus according to claim 4, further comprising a plurality of force piston/cylinder assemblies to move an upper roll assembly relative to a lower roll assembly to provide a desired gap between said roll assemblies.

6. An apparatus according to claim 5, further comprising means to actuate the force piston/cylinder assemblies in accordance with a desired initial roll gap setting.

7. An apparatus according to claim 6, further comprising a plurality of second upwardly convex surfaces on the top beam for contacting lower ends of the respective pistons of the force piston/cylinder assemblies when the latter are actuated.

8. In a metal plate 1leveller having a rigid housing, a bottom beam mounted in said housing, a near-rigid top beam mounted in said housing, an intermediate flexible beam disposed between the bottom beam and the top beam, said flexible beam being supported at its ends by one of a plurality of secondary bending piston/cylinder assemblies the other ends of which are connected to said housing, a set of upper roll assemblies mounted on the flexible beam, a set of driven upper work rolls and a set of driven lower work rolls mounted between the upper and lower roll assemblies, both of said sets of work rolls extending across the width of said housing and journalled for rotation in said housing for receiving therebetween metal plate to be worked, the upper and lower roll assemblies backing up the upper and lower work rolls, the improvement wherein the top beam has a plurality of downwardly convex surfaces adapted to contact an upper surface of said intermediate flexible beam so as to cause deflection thereof and the associated upper roll assembly to conform with deflection of the bottom beam and the associated lower roll assembly during passage of a metal plate through the leveller and to maintain said upper and lower roll assemblies in a substantially parallel relationship with each other, and wherein the apparatus further comprises a primary bending piston/cylinder assembly disposed between the secondary bending piston/cylinder assemblies and in which primary bending piston/cylinder assembly a lower end of the piston is juxtaposed to an upwardly convex bearing portion of the top surface of the flexible beam and which, when the piston is actuated to bear against the flexible beam, supplements the action of the secondary bending piston/cylinder assemblies to cause deflection of the flexible beam.

9. A method of roller levelling heavy plate comprising:

mounting a bottom beam on a leveller housing;

mounting a lower roll assembly on the bottom beam;

mounting a near rigid top beam on the leveller housing;

connecting each end of a single flexible beam disposed in a position intermediate the bottom beam and the rigid top beam to a plurality of secondary bending piston/cylinder assemblies, and connecting the other end of each such piston/cylinder assembly to the top beam;

mounting an upper roll assembly on the flexible beam;

mounting a primary bending piston/cylinder assembly on the top beam in a position intermediate the ends of the flexible beam with a lower end of the piston of such assembly in a position juxtaposable to an upper surface of the flexible beam;

continuously measuring the deflection of the bottom beam under load, and continuously actuating the primary and secondary bending piston/assemblies in response to deflection of the bottom beam to bend the flexible beam to an extent to compensate for the deflection of the bottom beam, thereby maintaining the upper and lower roll assemblies parallel to each other.

* * * * *